US006663108B2

(12) United States Patent
Makhoul

(10) Patent No.: US 6,663,108 B2
(45) Date of Patent: Dec. 16, 2003

(54) TABLETOP BASKETBALL GAME

(76) Inventor: Hadi Makhoul, 113 Ivystone Sq., Apt. H, Chesapeake, VA (US) 23320

( * ) Notice: Subject to any disclaimer, the term of this patent is extended or adjusted under 35 U.S.C. 154(b) by 0 days.

(21) Appl. No.: 10/127,112

(22) Filed: Apr. 22, 2002

(65) Prior Publication Data

US 2003/0197326 A1 Oct. 23, 2003

(51) Int. Cl.[7] ..... A63F 7/06; A63F 7/20

(52) U.S. Cl. ..... 273/317.3; 273/108.52; 273/119 R; 273/108.54

(58) Field of Search ..... 273/317.1, 317.3, 273/108.1, 108.52, 108.54, 108.56, 108.55, 129 R, 119 R, 129 V, 129 W

(56) References Cited

U.S. PATENT DOCUMENTS 3,416,799 A * 12/1968 Lopez
3,537,707 A * 11/1970 Goldberg
3,899,173 A * 8/1975 Zaris
3,901,508 A * 8/1975 Spangler
4,119,315 A * 10/1978 Goldfarb
4,260,152 A * 4/1981 Karlsen
4,382,598 A * 5/1983 McCloud
4,480,833 A * 11/1984 Barcelow
5,071,137 A * 12/1991 McCloud
5,072,880 A * 12/1991 McCloud
5,228,691 A * 7/1993 McAlley ..... 273/317.3
5,482,273 A * 1/1996 Wilton
5,605,328 A * 2/1997 Rudell
5,810,362 A * 9/1998 Jensen

* cited by examiner

*Primary Examiner*—Sebastiano Passaniti
(74) *Attorney, Agent, or Firm*—Bradley D. Goldizen

(57) ABSTRACT

The invention is a game that includes a miniature basketball court. Players control the rotational direction and the side to side movement of their team members. A player scores a goal by shooting a miniature basketball through a basket or hole in the goal. The basketball court comprises several crescent-shaped regions.

18 Claims, 5 Drawing Sheets

TABLETOP BASKETBALL GAME

There are no related applications.

The present invention was not subject to federal funding.

BACKGROUND OF THE INVENTION

1. Field of the Invention

The present invention relates to a tabletop version of the game of basketball. This invention is based on principles similar to that of foosball in which two to four players engage in a game that emphasizes and aids in the development/strengthening of hand and eye coordination.

2. Description of the Prior Art

Many games operated in arcades and pubs teach hand and eye coordination. Games, such as foosball or pool, train a user's dexterity and are operated in many entertainment businesses. These games are enjoyed by people of all ages and are usually a great source of revenue. They are also a source of entertainment for spectators. The games are manufactured in such a way that they are functional and affordable for both home and commercial uses.

SUMMARY OF THE INVENTION

The present invention is a tabletop basketball game having a series of crescent shaped regions that represents a basketball court. The basketball court includes typical markings such as a key, foul line and tip-off circle. Players of the game are positioned on opposite sides of the court facing one another.

Each player controls a team that has team members arranged on two rods. The rods are arranged above the basketball court and located equidistance from one another above the crescent shaped regions and allow two-dimensional movement of the team members. The team members can be rotated about the rods and can be moved towards and away from the players. Each team member has a spoon-like feature for accommodating a miniature basketball.

The game includes backboards at either end of the basketball court and has two methods of scoring. In the first scoring method, a player's team members slam dunk the miniature basketball by throwing it through a hoop or net located against a backboard. A goal is also scored by rolling or throwing the miniature basketball through a goal opening located below the hoop or net.

Other embodiments of the game include three-point lines similar to those displayed on actual basketball courts. When a player shoots and scores from outside the three-point line, he will score a greater number of points than if he shoots inside the three-point line.

It is an object of the invention to provide and teach a game that is enjoyed by people of all ages.

It is another object of the invention to provide a game that is easy to operate, uses no electricity and may be a source of revenue for the owner.

It is another object of the invention to provide a game that improves dexterity and is affordable for both home and commercial uses.

These objects and others will become apparent when the aforementioned discussion is taken in conjunction with the following disclosure.

DETAILED DESCRIPTION OF THE INVENTION

The following is the preferred embodiment or best mode for carrying out the invention. It should be noted that this invention is not limited by the discussion of the preferred embodiment.

Figure 1:
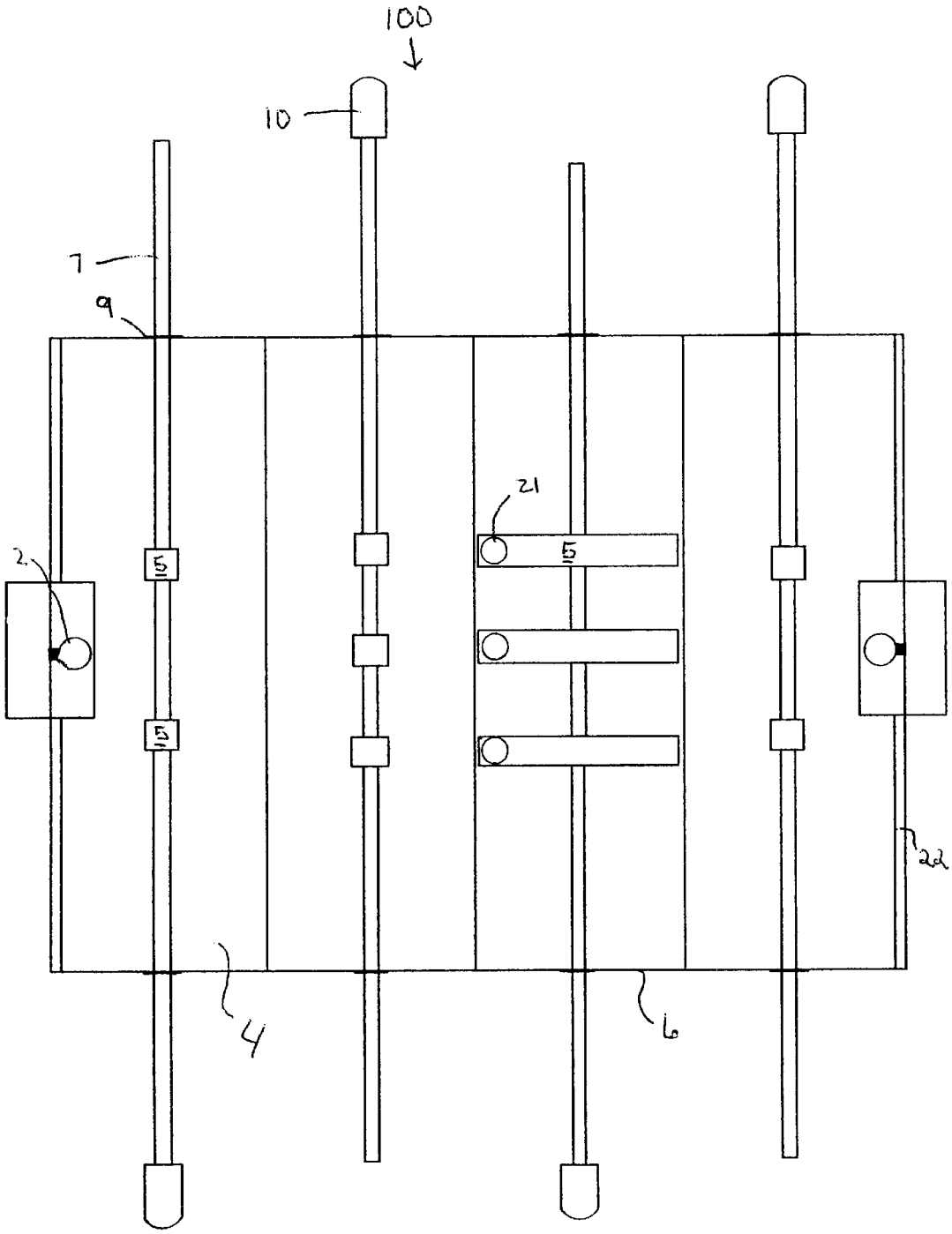
FIG. 1 is an overhead view of the invention.

FIG. 1 is an overhead view of the game 100. Baskets or hoops 2 are located at each end of the basketball court 4. Four rods 7 intersect side panels 6. The rods 7 pass through bearings 9 or other friction reducing means. The rods 7 include players 5 affixed thereto. Handles 10 are attached to an end of the rods 7. End boards 22 support baskets or hoops 2.

Figure 2:
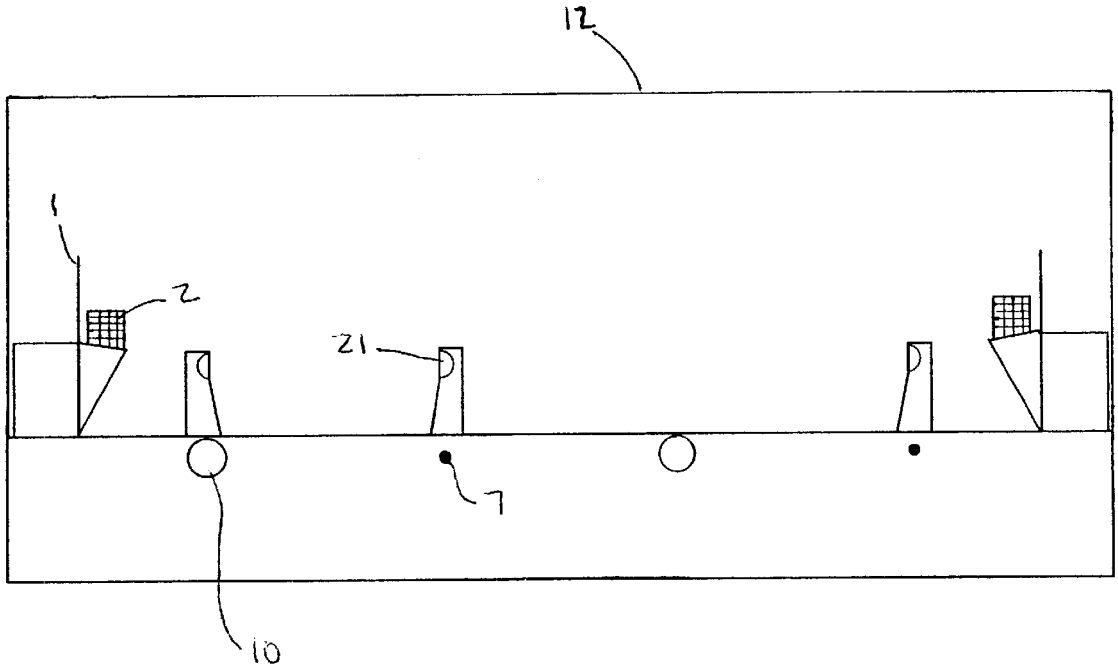
FIG. 2 is a side view of the invention.

FIG. 2 is a side view of the game 100. A cover 12 comprised of transparent plastic or plexi-glass prevents the ball 11 from being thrown from or leaving the game 100. Backboards i are provided behind hoops 2. The backboards 1 are used in the same manner as those in a regular basketball game. The ball 11 can be thrown -against the backboard 1 causing the ball 11 to be deflected into the hoop 2. Team members 5 include spoon-like recesses 21 for moving the ball 11 towards the goal 3.

Figure 3:
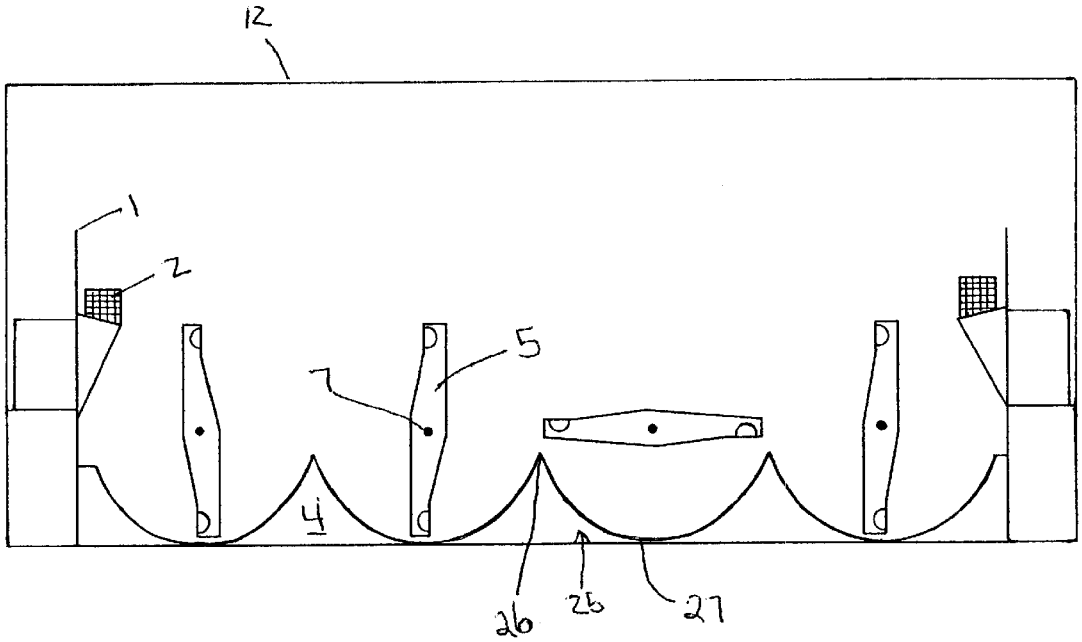
FIG. 3 is a cross-sectional side view of the invention.

FIG. 3 is a cross-sectional side view of the game 100. The court 4 comprises a plurality of crescent-shaped portions 25. Each crescent-shaped portion 25 includes two peaks 26 and one valley 27. Team members 5 are positioned above the valleys 27 such that the ends of the team members 5 maintain a constant distance from the court 4 as the team members 5 are rotated around the rods 7. The team members 5 are equipped with two spoon-like recesses 21, one recess on either side of the team member 5.

Figure 4:
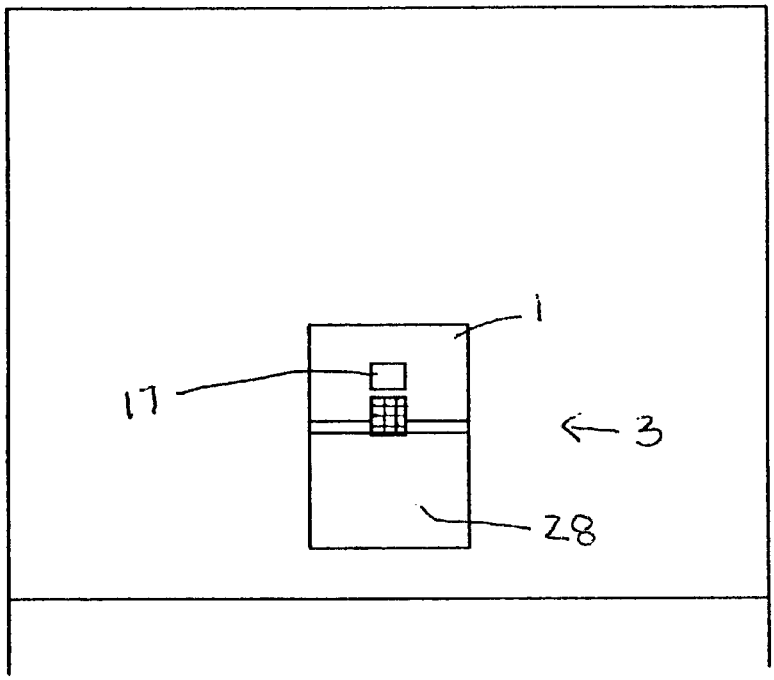
FIG. 4 is an end view of the goal.

FIG. 4 is a view of the goal 3. The backboard 1 includes a shooting square 17. The ball 11 is thrown towards the shooting square 17 on backboard 1. If the ball 11 hits the shooting square 17, it will deflect into the hoop 2 to score points. The goal 3 also includes an opening 28 into which the ball 11 may be rolled or thrown to score.

Figure 5:
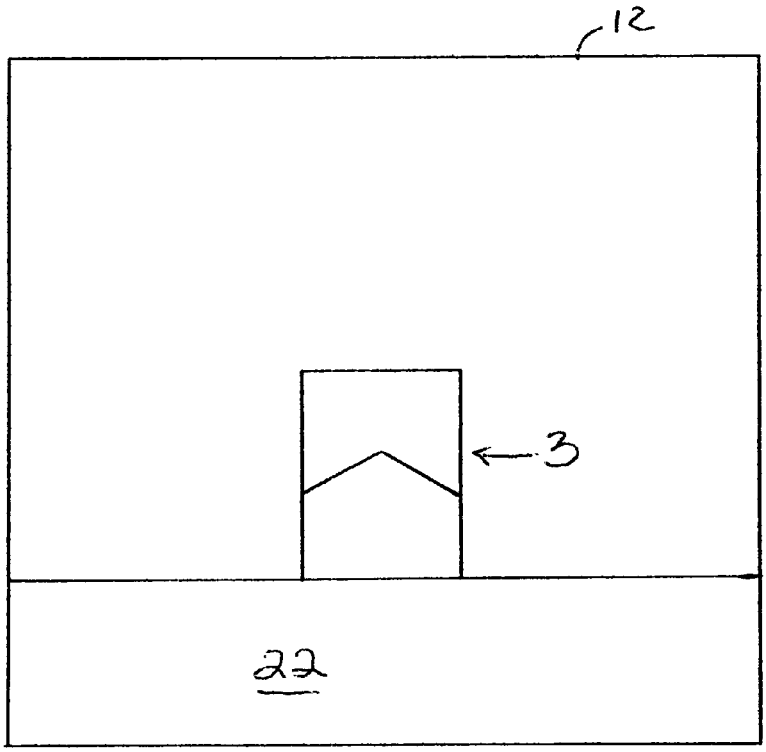
FIG. 5 is an end view of the invention.

FIG. 5 is an end view of the game 100. End boards 22 support the goal 3 and backboard 1. Cover 12 prevents the ball 11 from leaving the playing surface of the game 100.

Figure 6:
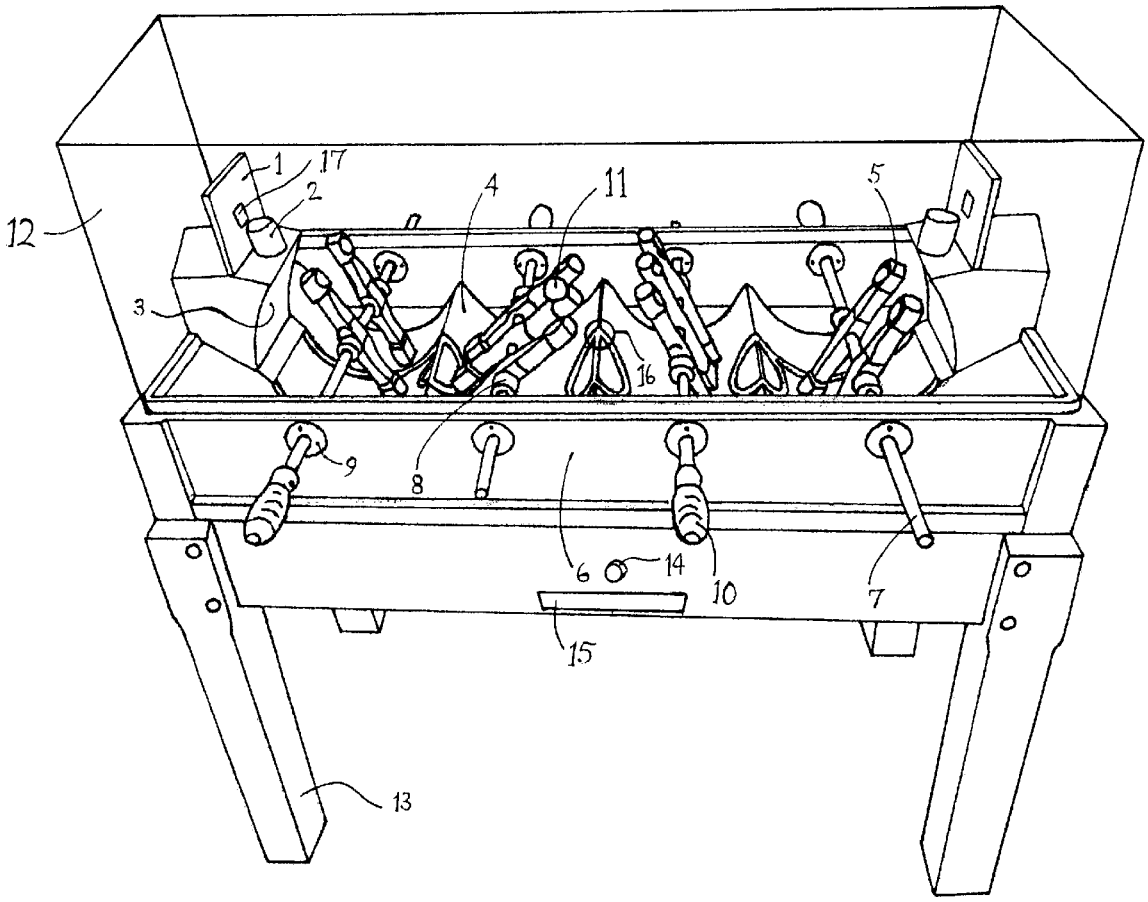
FIG. 6 is a perspective view of the invention.

FIG. 6 is a perspective view of the game 100. A player grasps the handles 10 and controls the movement of the team members 5 by twisting the handles 10 to rotate team members 5. The team members 5 move across the court 4 by sliding the rods 7 through the bearings 9. Stoppers 8 prevent the team members 5 from being pushed into side panels 6.

As shown in FIG. 6, a player moves the ball 11 by positioning it in the spoon-like recess 21 and throwing or rolling the ball 11 towards the goal 3. Basketball markings simulating those on a real basketball court are provided on court 4, as shown. Legs 13 are provided on the game 11.

An opening 16 is provided for putting the basketball into play. A player simply drops the ball 11 onto the basketball court 4 through the opening 16 and the game begins. It should be noted that the opening 16 is shown on the side of the cover 12 for ease in understanding the invention. However, the opening 16 may be provided above the middle of the basketball court 4. Or, openings may be provided on both sides of cover 12 for allowing each player a chance to put the basketball into play.

The game 100 is also equipped with a ball return slot 15. In the residential version of the game, the ball 11 returns to the ball return slot 15 after a goal has been scored. Tubing or other suitable means guide the ball from either goal into the ball return slot 15.

Game 100 is also shown with a coin slot or actuator 14. A player deposits a predetermined amount of coins into the coin slot 14 to have a ball deposited into the ball return slot 15. This feature is only provided on the commercial use version of the game. The game 100 may be equipped with a mechanism that allows a predetermined number of goals to be scored before a player must deposit more money to continue playing the game. It may also be equipped with a timer for timing either halves or quarters of the total game.

It is to be understood that the invention is not limited to the exact construction illustrated and described above, but that various changes and modifications may be made without departing from the spirit and the scope of the invention as defined in the following claims.

I claim:

1. A game comprising:

a miniature basketball court having sideboards and a basketball:

a plurality of team members arranged on rods that pass through said sideboards; and, goals arranged at each end of the basketball court, each goal including a basket arranged above an opening such that points may be scored by one of throwing the basketball through the basket or rolling the basketball through the opening.

2. The game of claim 1 wherein said rods are parallel to to one another.

3. The game of claim 1 wherein said team members include a recess for receiving a miniature basketball.

4. The game of claim 1 further comprising backboards to which said baskets are attached.

5. The game of claim 1 further comprising handles affixed to said rods.

6. The game of claim 1 further comprising stops fixed to said rods for preventing the team members from contacting the sideboards.

7. The game of claim 1 further comprising friction reducing means affixed to said sideboards and through which said rods pass.

8. The game of claim 1 wherein said miniature basketball court includes crescent-shaped portions.

9. The game of claim 1 further comprising legs for supporting the miniature basketball court.

10. The game of claim 1 further comprising a protective covering for preventing the basketball from leaving the miniature basketball court.

11. The game of claim 1 wherein said basketball comprises a lightweight durable plastic material.

12. A miniature basketball game including a basketball comprising:

a basketball court having sideboards and a plurality of crescent-shaped portions;

a plurality of basketball players arranged on rods that pass through said side boards; and goals arranged at each end of the basketball court, each goal including a basket arranged above an opening such that points may be scored by one of throwing the basketball through the basket or rolling the basketball through the opening.

13. The miniature basketball game of claim 12 wherein said players include a recess for receiving the basketball.

14. The miniature basketball game of claim 12 further comprising backboards attached to said goals.

15. The miniature basketball game of claim 12 further comprising legs.

16. The miniature basketball game of claim 12 further comprising a protective covering.

17. The miniature basketball game of claim 12 wherein said rods are parallel to one another.

18. A miniature basketball game comprising:

a basketball court that includes sideboards, end boards and crescent-shaped portions;

goals affixed at each end of said basketball court, said goals including a basket arranged above an opening such that points may be scored by throwing a miniature basketball through the basket or rolling the miniature basketball through the opening; and, a plurality of basketball players arranged on rods that pass through said sideboards, each of said basketball players includes at least one recess for receiving the miniature basketball, said rods includes handles attached thereto.

* * * * *